United States Patent [19]

Nishimura

[11] 4,326,794

[45] Apr. 27, 1982

[54] ELECTROSTATIC COPYING APPARATUS

[75] Inventor: Fuminobu Nishimura, Yokohama, Japan

[73] Assignee: Tokyo Shibaura Denki Kabushiki Kaisha, Kawasaki, Japan

[21] Appl. No.: 202,172

[22] Filed: Oct. 29, 1980

[30] Foreign Application Priority Data

Oct. 31, 1979 [JP] Japan ..... 54/139765

[51] Int. Cl.[3] ..... G03G 15/00

[52] U.S. Cl. ..... 355/3 R; 355/3 CH; 355/14 CH

[58] Field of Search ..... 355/35, 3 CH, 14 CH, 355/14 E, 14 B

[56] References Cited

U.S. PATENT DOCUMENTS

| | | | |
|---|---|---|---|
| 3,819,259 | 6/1974 | Lux | 355/3 R |
| 4,062,631 | 12/1977 | Ichikawa et al. | 355/3 R |
| 4,066,351 | 1/1978 | Kidd | 355/3 R |
| 4,133,609 | 1/1979 | Arai | 355/3 R |
| 4,136,941 | 1/1979 | Sawaoka | 355/3 R |
| 4,174,170 | 11/1979 | Yamamoto et al. | 355/3 CH X |

FOREIGN PATENT DOCUMENTS 49-4337 1/1974 Japan .

*Primary Examiner*—J. V. Truhe
*Assistant Examiner*—Richard M. Moose
*Attorney, Agent, or Firm*—Cushman, Darby & Cushman

[57] ABSTRACT

An electrostatic copying apparatus comprising a photosensitive layer prepared from a photoconductive material, corona discharge unit which generates a corona discharge to form an electrified corona discharge region on the photosensitive layer, light-emitting unit which is disposed adjacent to the corona discharge unit and emits light beams over the electrified corona discharge region of the photosensitive layer, thereby producing a conductive light-irradiated region on the photosensitive layer, and adjustment device for controlling the dimensions of the light-irradiated region to control the overlapping portions of the light-irradiated region and corona discharge region, thereby selectively defining the substantially electrified portion of the corona discharge region.

2 Claims, 5 Drawing Figures

ELECTROSTATIC COPYING APPARATUS

BACKGROUND OF THE INVENTION

This invention relates to an electrostatic copying apparatus and more particularly to an electrostatic copying apparatus which is provided with an electrifying device capable of defining a surface potential of a photosensitive layer during electrification.

An electrostatic copying apparatus is generally provided with a photosensitive drum, which comprises a drum body acting as a conductive support and a photosensitive layer which is prepared from a photoconductive material and mounted over the peripheral surface of the drum body. The photosensitive layer undergoes the sequential copying steps of electrification, exposure to light, development, transcription, cleaning and discharge. The electrification step is carried out by the electrifying device.

Electrification by the electrifying device is generally carried out by exposing a photosensitive layer to a corona discharge, and depositing ions emitted from the corona discharge on the surface of the photosensitive layer. In the corona discharge a high voltage of several thousand volts is impressed on a space defined between a fine conductor set immediately above the photosensitive layer and the drum body. A corona emitted from the conductor ionizes the surrounding air molecules to generate ions. Deposition of ions on the photosensitive layer gives rise to its surface potential. The surface potential prominently affecting the concentration of a transcribed image should always be stabilized.

In this connection, it will be noted that the photosensitive layers of successively replaced photosensitive drums, though prepared from the same material, indicate some variations in the static electrical characteristic. Even when an exactly fixed voltage is impressed, the surface potentials of the photosensitive layers have hitherto varied within the range of ±50 V for each photosensitive drum. Where, therefore, an old photosensitive drum whose photosensitive layer is already deteriorated is replaced by a new photosensitive drum, then the photosensitive layer of the new photosensitive drum may have a higher or lower surface potential than that of the photosensitive layer of the old photosensitive drum which originally proved satisfactory. In such case, the concentration of an image transcribed by the new photosensitive drum will change, resulting in a decline in the picture quality of the image.

For stabilization of the surface potential of the photosensitive layer, therefore, it has hitherto been necessary to adjust an output from a voltage-impressing transformer or a distance between a corona-producing conductor and photosensitive layer. In either case, adjustment has been carried out very unsatisfactorily. In the former case, the surface potential widely varies with any slight change in an amount of electric energy discharged by voltage impression. For the stabilization of the surface potential, therefore, an output from the voltage-impressing transformer has to be very minutely adjusted. Where, in the latter case, a distance between the conductor and photosensitive layer varies by about one millimeter, then the surface potential indicates as wide a change as about 100 V. Therefore, the adjustment of the distance demands an advanced skill. Further, if the adjustment proves unsatisfactory, then irregular electrification undesirably results.

SUMMARY OF THE INVENTION

This invention has been accomplished in view of the above-mentioned circumstances, and is intended to provide an electrostatic copying apparatus which ensures the easy adjustment of the surface potential of a photosensitive layer, the stabilization of the surface potential regardless of the replacement of photosensitive drums having different static electrical characteristics and the prevention of variations in the concentration of a transcribed image for improved picture quality.

According to an aspect of this invention, there is provided an electrostatic copying apparatus comprising:

a photosensitive layer prepared from a photoconductive material;

corona discharge means which generates a corona discharge to form an electrified corona discharge region on the photosensitive layer;

light-emitting means which is disposed adjacent to the corona discharge means and emits light beams over the electrified corona discharge region of the photosensitive layer, thereby producing a conductive light-irradiated region on the photosensitive layer; and adjustment means for controlling the dimensions of the light-irradiated region to control the overlapping portions of the light-irradiated region and corona discharge region, thereby properly defining the substantially electrified portion of the corona discharge region.

DETAILED DESCRIPTION OF THE PREFERRED EMBODIMENT

Figure 1:
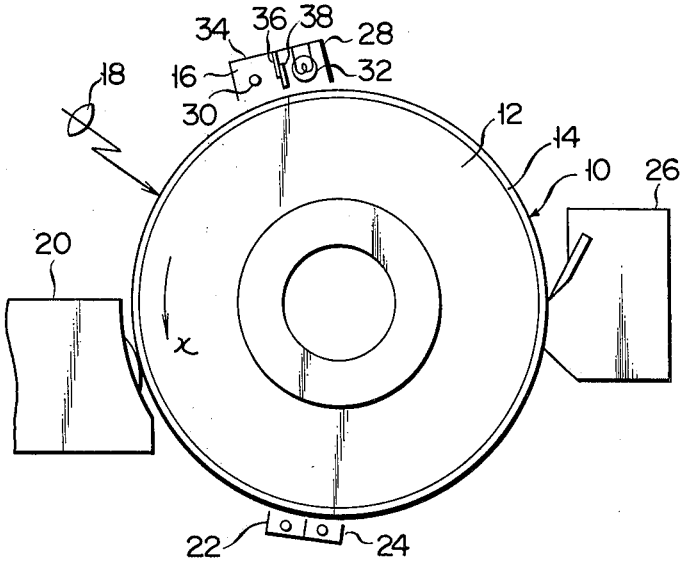
FIG. 1 schematically shows the arrangement of an electrostatic copying apparatus according to one embodiment of this invention.

Description is now given with reference to the accompanying drawings of an electrostatic copying apparatus embodying this invention. A photosensitive drum 10 is rotatably set in the electrostatic copying apparatus and connected to a drive mechanism (not shown). The photosensitive drum 10 comprises a drum body 12 of, for example, aluminium acting as a conductive support and a photosensitive layer 14 which is prepared from, a photoconductive material, for example, an alloy of selenium and tellurium with a thickness of scores of microns and deposited over the peripheral surface of the drum body 12. The photosensitive drum 10 is rotated by a drive mechanism for a prescribed length of time in a counterclockwise direction indicated by x in FIG. 1.

Sequentially arranged around the photosensitive drum 10 in the direction of x are:

an electrifying device 16 for electrifying the photosensitive layer 14 to render it sensitive to light beams;

an optical device 18 for exposing the photosensitive layer 14 to light beams, thereby producing a static latent on the photosensitive layer 14 the static latent image corresponding to the image of an original being copies;

a developing device 20 for developing the static latent image by a toner;

a transcribing device 22 for transferring a developed image on to a paper sheet;

a releasing device 24 for peeling an image-bearing paper sheet from the surface of the photosensitive drum 10;

a cleaning device 26 for removing the remainder of the toner left on the surface of the photosensitive layer 14; and a discharging device 28 for driving off the electric energy remaining on the surface of the photosensitive layer 14.

The electrifying device 16 includes a corona discharge unit, and the discharging device 28 includes a light-emitting unit. The corona discharge unit comprises a fine corona discharge wire 30, and the light-emitting unit comprises a light source. The electrifying device 16 and discharging device 28 are set spatially adjacent to each other in a common casing 34 with a partition wall 36 interposed therebetween. The partition wall 36 is fitted with the later described adjustment device 38.

Figure 2:
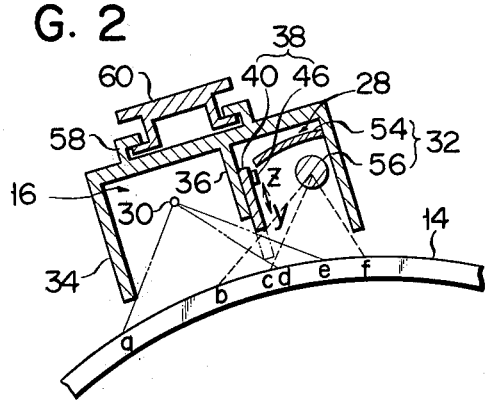
FIG. 2 is a schematic sectional view of an electrifying device used with the electrostatic copying apparatus shown in FIG. 1.

As seen from FIG. 2, the casing 34 is open on one side. The opening spatially faces the photosensitive layer 14. The casing 34 extends in the axial direction of the photosensitive drum 10. The partition wall 36 vertically projects from the remote side of the casing 34 from the opening (the upper board of the casing 34 as indicated in FIG. 2). The lower end of the partition wall 36 is set more apart from the photosensitive layer 14 than the lower end of the casing 34. The left side chamber of FIG. 2 defined by the partition wall 36 is used as a space for receiving the corona discharge unit or electrifying device 16. The right side chamber of FIG. 2 defined by the partition wall 36 is provided to hold the light-emitting unit or discharging device 28.

Figure 3:
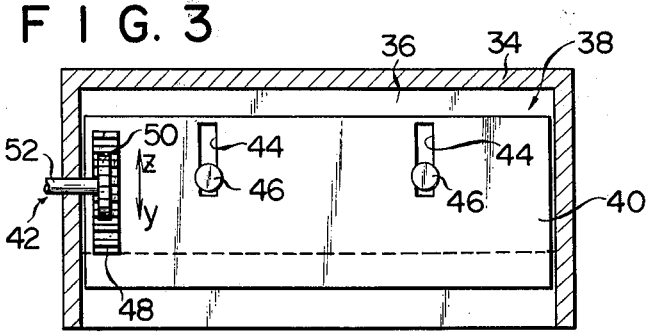
FIG. 3 is a schematic front view of an adjustment device used with the electrifying device shown in FIG. 2.

As shown in FIG. 3, the adjustment device 38 comprises a dimension-defining board 40 which is prepared from an opaque material and is made linearly movable along the partition wall 36 in a vertical direction indicated by the arrows y, z and a drive mechanism 42 for moving the dimension-defining board 40. A pair of slits 44 extending in a vertical direction indicated by the arrows y, z are formed in the dimension-defining board 40. A pair of pins 46 fitted to the partition wall 36 are respectively inserted into the paired slits 44. The pin 46 has a circular head whose diameter is made larger than the width of the slit 44, thereby causing the dimension-defining board 40 to be moved only in the direction indicated by the arrows y, z.

The drive mechanism 42 comprises a rack 48 mounted on the dimension-defining board 40 in a state extending in the direction indicated by the arrows y, z, a pinion 50 threadedly engageable with the rack 48 and a shaft 52 concentrically fixed to the pinion 50 to rotatably support the pinion 50 in the casing 34. Where, therefore, the shaft 52 is rotated clockwise or counterclockwise, then the dimension-defining board 40 is moved correspondingly in the direction of the arrow y or z.

In FIG. 2, a light source 32 of the light-emitting unit or discharging device 28 comprises a reflector 54 positioned near the upper wall of the right side chamber of the casing 34 and a lamp 56 set in the upper region of the right side chamber closely below the reflector 54. Light beams emitted from the lamp 56 release electric energy charged in that portion of the surface area of the photosensitive drum 10 which is defined by two parallel lines extending along the full length of the photosensitive drum 10 and those portions of the circumferential edges at both ends of the photosensitive drum 10 which have a prescribed length (that portion of the surface area of the photosensitive drum 10 is hereinafter referred to as "a light-irradiated region").

A corona sent forth from the corona wire 30 electrifies that portion of the surface area of the photosensitive layer 14 which is defined by two parallel lines extending along the full length of the photosensitive layer 14 and those portions of the circumferential edges at both ends of the photosensitive layer 14 deposited on the cylindrical photosensitive drum 10 which have a prescribed length (that portion of the surface area of the photosensitive layer 14 is hereinafter referred to as "a corona discharge region").

In this case, it will be noted that both light-irradiated region and corona discharge region have the similar shape but have different lengths. The mutually facing portions of both regions overlap each other. The light-emitting unit or discharging device 28 for forming the above-defined light-irradiated region concurrently acts to release electric energy charged in the corona discharge region produced by the electrifying device 16 and also define the corona discharge region.

The widths of the light-irradiated region and corona discharge region vary accordingly as the dimension-defining board 40 is moved in the direction of the arrow y or z. In other words, where the dimension-defining board 40 is moved in the direction of the arrow z, and the lower end of the dimension-defining board 40 is most removed from the photosensitive layer 14, then the light-irradiated region is constituted by an area defined between reference numerals b and f given in FIG. 2. On the other hand, the corona discharge region is constituted by an area defined between reference numerals a and e shown in FIG. 2. Where the dimension-defining board 40 is moved in the direction of the arrow y, and the lower end of the dimension-defining board 40 most approaches the photosensitive layer 14, then the light-irradiated region is constituted by an area defined between reference numerals c and f. On the other hand, the corona discharge region is constituted by an area defined between reference numerals a and d.

As seen from FIG. 2, a rail rest 58 extending in the axial direction of the photosensitive drum 10 is fitted to the surface of the upper board of the casing 34. A rail 60 engaging the rail rest 58 is set on the body of the subject electrostatic copying apparatus (not shown). The casing 34 is mounted detachably in a state removable to the outside of the body of the electrostatic copying apparatus along the rail 60.

Description is now given of the principle by which the electrifying device 16 and discharging device 28 are operated and the interrelationship therebetween. Where, with the electrifying device 16, a high voltage is impressed on a region defined between the corona wire 30 and the body 12 of the photosensitive drum 10, then the corona wire 30 starts a corona discharge. At this time, air molecules surrounding the corona wire 30 are ionized. As a result, ions are deposited on the surface of the photosensitive layer 14 of the corona discharge region to electrify the photosensitive layer 14. The surface potential of the photosensitive layer 14 which represents a total amount of electric energy charged in the surface of the photosensitive layer 14 is governed by the area of the corona discharge region, under the condition in which the level of impressed voltage and the static characteristic of the photosensitive layer 14 are stabilized.

Where, with the discharging device 28, the lamp 56 is actuated to emit light beams, then the photosensitive layer 14 of the light-irradiated region is rendered conducting. As a result, the photosensitive layer 14 thus rendered conducting can not hold electric energy previously charged therein. Accordingly, the electric energy is earthed through the body 12 of the photosensitive drum 10 acting as a conductive support.

Figure 4:
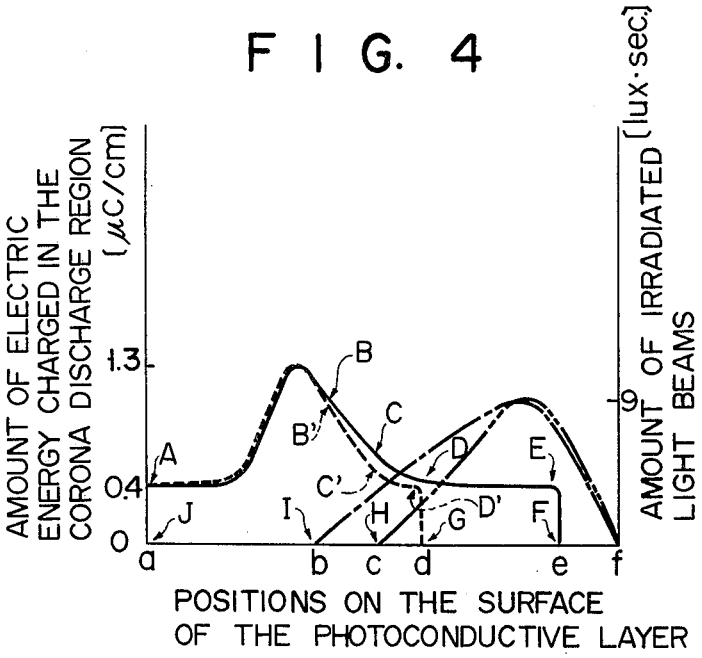
FIG. 4 diagrammatically illustrates an amount of electric energy charged in the corona discharge region and an amount of light irradiated on the corona discharge region when the dimension-defining board of the adjustment means of FIG. 3 is set in the uppermost or lowermost position.

As aforementioned, the mutually facing portions of the corona discharge region of the electrifying device 16 and the light-irradiated region of the discharging device 28 overlap each other. Where, therefore, the lower end of the dimension-defining board 40 is most removed from the surface of the photosensitive layer 14, the corona discharge region is constituted by an area defined between the points on the surface of the photosensitive layer 14 denoted by the reference numerals a and e. In other words, a total amount of electric energy charged in the corona discharge region is indicated by an amount of electric energy charged in an area surrounded by reference numerals A-B-C-D-E-F-G-H-I-J-A as indicated in a solid line in FIG. 4. On the other hand, the light-irradiated region is constituted by an area defined between the points on the photosensitive layer 14 denoted by the reference numerals b and f (as indicated in a dot-dash line in FIG. 4). This area of the photosensitive layer 14 is rendered conducting, and is no longer able to hold electric charges. As a result, electric energy is retained only in an area defined between the reference numerals a and b. A total amount of electric energy charged in the area is represented by an amount of electric energy charged in an area surrounded by the reference numerals A-B-I-J-A in FIG. 4. The surface potential of the photosensitive layer 14 defined by the total amount of electric energy is about 500 volts, that is, a minimum amount as can be inferred from FIG. 4.

Where the lower end of the dimension-defining board 40 most approaches the surface of the photosensitive layer 14, then the corona discharge region is constituted by an area defined between the points on the surface of the photosensitive layer 14 denoted by the reference numerals a and d as indicated in a broken line in FIG. 4. A total amount of electric energy charged in this area is represented by an amount of electric energy charged in an area surrounded by reference numerals A-B'-C'-D'-G-H-I-J-A. This total amount of electric energy is obviously smaller than a total amount of electric energy obtained when the lower end of the dimension-defining board 40 is most removed from the surface of the photosensitive layer 14. On the other hand, the light-irradiated region is constituted by an area defined between the points on the surface of the photosensitive layer 14 denoted by the reference numerals c and f as indicated in a 2 dots-dash line in FIG. 4. As a result, the conducting portion of the photosensitive layer 14 decreases, causing an area capable of substantially holding electric energy to be enlarged to that which is defined between the reference numerals a and c. A total amount of electric energy charged in this increased area represents a total amount of energy charged in an area surrounded by the reference numerals A-B'-C'-H-I-J-A. The surface potential of the photosensitive layer 14 defined by that total amount of electric energy is about 600 volts, a maximum value as clearly seen from FIG. 4.

Figure 5:
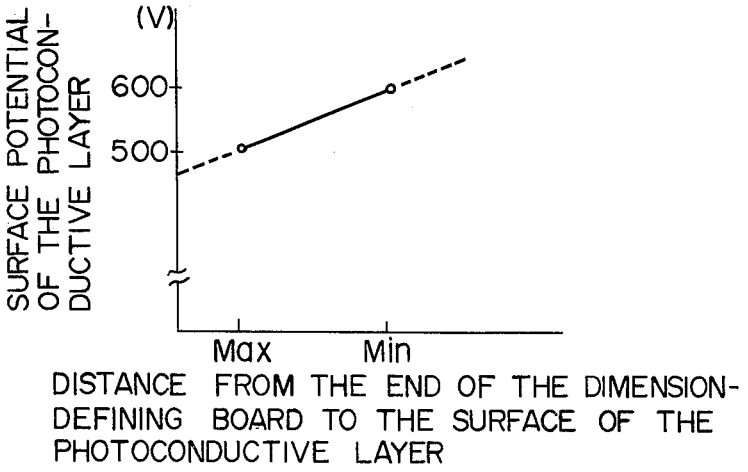
FIG. 5 graphically indicates the relationship between the position of the dimension-defining board and the surface potential of a photosensitive layer.

The surface potential of the photosensitive layer 14 varies substantially linearly with the movement of the dimension-defining board 40, as illustrated in a solid line in FIG. 5. The abscissa of FIG. 5 shows a distance between the lower end of the dimension-defining board 40 and the surface of the photosensitive layer 14. The shorter the distance, the larger the size in which the dimensions of both corona discharge region and light-irradiated region are defined. Conversely, the longer the distance, the smaller the size in which the dimensions of the corona discharge region and light-irradiated region are formed. In other words, the larger the size in which the dimensions are defined, the higher the surface potential of the photosensitive layer 14. Conversely, the smaller the dimension-defining extent, the lower the surface potential.

Where, therefore, the position of the dimension-defining board 40 is properly controlled in accordance with the static characteristic of the photosensitive layer 14, then it is possible to adjust a total amount of electric energy held by the photosensitive layer 14. In other words, the surface potential of the photosensitive layer 14 can be stabilized for each photosensitive drum 10 replaced from time to time.

Description is now given of the operation of an electrostatic copying apparatus embodying this invention.

Where a copying operation is carried out by a new photosensitive drum 10, the casing 34 is first removed from the rail 60 to be separated from the body of the copying apparatus. The pinion 50 rotatably fitted to the removed casing 34 is rotated by manually turning the shaft 52. When the pinion 50 is rotated, then the rack 48 engaged therewith is moved. As a result, the dimension-defining board 40 is also moved in accordance with the manner in which the pinion 50 is rotated. The photosensitive layer 14 is made to have a given surface potential by controlling the dimensions of the overlapping portions of the corona discharge region of the electrifying device 16 and the light-irradiated region of the discharging device 28 with the position of the dimension-defining board 40 properly adjusted.

After the surface potential of the photosensitive layer 14 is adjusted, the casing 34 is put back into the body (not shown) of the electrostatic copying apparatus by means of the rail 60.

Later when the electrostatic copying apparatus begins to be operated, the photosensitive drum 10 is rotated in the direction of the arrow x. This rotation causes the photosensitive layer 14 to have a desired surface potential by an interaction between the electrifying device 16 and discharging device 28. A static latent image is formed on the energy charged photosensitive layer 14 by means of the optical device 18. The latent image is developed by means of a toner in the developing device 21. A toner-developed image on the photosensitive layer 14 is transcribed in the transcribing device 22 on to the surface of a separately supplied copy sheet. The image-impressed copy sheet is removed from the photosensitive layer 14 by the peeling device 24, and carried to a fixing device (not shown). A toner-developed image transcribed on the copy sheet is fixed in the fixing device to provide a copied impression.

The remainder of a toner left on the surface of the photosensitive layer 14 on which a developed image has been transcribed is removed by the cleaning device 26. The electric energy remaining on the surface of the photosensitive layer 14 is released by the discharging device 28. The above-mentioned steps complete the copying cycle.

Where a photosensitive drum 10 is found to be too much deteriorated for further application as a result of maintenance, and the old photosensitive drum is replaced by a new one, then an electrostatic copying apparatus embodying this invention enables a total amount of electric energy charged in the photosensitive layer 14 (that is, the surface potential thereof) of a new photosensitive drum 10 (even if the photosensitive layer 14 has a somewhat different static characteristic from that of the old photosensitive drum) to be easily and accurately controlled simply by properly adjusting the position of the dimension-defining board 40. In other words, this invention enables the surface potential of the photosensitive layer 14 of a new photosensitive drum 10 to readily coincide with that of the photosensitive layer 14 of the old photosensitive drum 10 if it proved to a satisfactory one. Therefore, variations between the concentrations of developed images impressed on copy sheets by successively replaced photosensitive drums 10 are suppressed, thereby always ensuring a good picture quality.

The position of the dimension-defining board 40 can be easily adjusted by removing the casing 34 holding the board 40 from the body of an electrostatic copying apparatus. A light-emitting devide for producing a light-irradiated region defining a corona discharge region formed by the electrifying device 16 concurrently acts as a light-emitting device for the discharging device 28, thereby saving a space occupied by the subject electrostatic copying apparatus and reducing its cost.

This invention is not limited to the abovementioned embodiment, but is applicable in various modifications without departing from the spirit and object of the invention. In other words, the object of the invention can be fully attained even if a light emitting device for the discharging device 28 and a light-emitting device for defining a corona discharge region produced by the electrifying device 16 are separately provided. Further, the dimension-defining board 40 may be fitted to the casing 34 directly, instead of the partition wall 36 thereof. The dimension-defining board 40 may be moved rotatably instead of linearly. Further, a slit formed in the dimension-defining board may be suitably opened or closed, instead of causing in the dimension-defining board 40 itself to be moved.

What is claimed is:

1. An electrostatic copying apparatus comprising:

a rotatable drum having an outer photosensitive layer made of a photoconductive material;

corona discharge means for generating a corona discharge to form an electrified corona discharge region on the photosensitive layer;

light-emitting means which is disposed adjacent to the corona discharge means and emits light beams over the electrified corona discharge region of the photosensitive layer, for producing a conductive light-irradiated region overlapping the corona discharge region on the photosensitive layer; and adjustment means for controlling the dimensions of the light-irradiated region to control the overlapping portions of the light-irradiated region and corona discharge region, thereby selectively defining a substantially electrified portion of the corona discharge region, the adjustment means comprising a movable dimension-defining board arranged between the corona discharge means and light-emitting device, and a drive mechanism for moving the dimension-defining board radially with respect to the photosensitive drum to a prescribed position; the area of the overlapping portions of the corona discharge region and light-irradiated region varying with the position of the dimension-defining board.

2. An electrostatic copying apparatus comprising: a rotatable drum having an outer photosensitive layer made of a photoconductive material;

corona discharge means for generating a corona discharge to form an electrified corona discharge region on the photosensitive layer;

light-emitting means which is disposed adjacent to the corona discharge means and emits light beams over the electrified corona discharge region of the photosensitive layer, for producing a conductive light-irradiated region overlapping the corona discharge region on the photosensitive layer, the light emitting means comprising means for preventing electric energy from being held in the conductive photosensitive layer of the light-irradiated region, thereby acting as a discharging means; and adjustment means for controlling the dimensions of the light-irradiated region to control the overlapping portions of the light-irradiated region and corona discharge region, thereby selectively defining a substantially electrified portion of the corona discharge region, the adjustment means comprising a movable dimension-defining board arranged between the corona discharge means and light-emitting device, and a drive mechanism for moving the dimension-defining board radially with respect to the photosensitive drum to a prescribed position; the area of the overlapping portions of the corona discharge region and light-irradiated region varying with the position of the dimension-defining board.

* * * * *